US005850966A

United States Patent [19]

Siler et al.

[11] Patent Number: 5,850,966

[45] Date of Patent: Dec. 22, 1998

[54] DEPOSIT RETRIEVAL AND TRANSPORT SECURITY APPARATUS

[75] Inventors: Buzz L. Siler, Lake Oswego, Oreg.; Roger H. Pierce, Vancouver, Wash.

[73] Assignee: SafePak, Inc., Portland, Oreg.

[21] Appl. No.: 682,053

[22] Filed: Jul. 16, 1996

[51] Int. Cl.[6] ..... G07B 15/00

[52] U.S. Cl. ..... 232/15; 232/1 D; 109/46; 109/52

[58] Field of Search ..... 232/15, 1 D, 16; 109/46, 47, 52

[56] References Cited

U.S. PATENT DOCUMENTS

| | | | |
|---|---|---|---|
| 140,985 | 7/1873 | Winchell | 232/15 |
| 2,973,139 | 2/1961 | Leone et al. | 232/15 |
| 3,741,464 | 6/1973 | Verbeke | 232/15 |
| 3,843,043 | 10/1974 | Sciortino | 232/15 |
| 4,638,746 | 1/1987 | Ishigure | 232/15 X |
| 5,161,736 | 11/1992 | Roccoberton et al. | 232/15 |
| 5,533,605 | 7/1996 | Mays et al. | 232/15 X |
| 5,611,483 | 3/1997 | Sciortino | 232/15 |
| 5,619,932 | 4/1997 | Efland et al. | 232/15 X |
| 5,715,933 | 2/1998 | Dekker et al. | 232/15 |

*Primary Examiner*—Blair M. Johnson
*Attorney, Agent, or Firm*—Olson and Olson

[57] ABSTRACT

A deposit collecting and transporting security apparatus provides a deposit container arranged to be lockably mounted for receiving and collecting deposits from a depository outfeed apparatus. In order to remove the container for transport to a deposit processing facility, a container-closing lid panel is slid onto the container into position closing the confines thereof against access whereupon the lid panel is automatically locked in place against removal. Thus locked against removal, further slight sliding movement of the lid panel overrides and disengages a container mounting lock, thereby permitting the container to be removed from the depository for transport only after the lid panel has been installed and locked into operative position securing the confines of the container against access.

3 Claims, 7 Drawing Sheets

DEPOSIT RETRIEVAL AND TRANSPORT SECURITY APPARATUS

BACKGROUND OF THE INVENTION

This invention relates generally to bank night depositories, automated teller machine (ATM) depositories, under-counter depositories, gaming table depositories and the like, and more particularly to a novel deposit retrieval and transport apparatus arranged to facilitate the secure collection and transport of deposited material from depositories to its destination at a deposit processing facility.

Typically, unattended bank night depositories, ATM depositories and the like are emptied of deposits on a pre-arranged schedule by bank employees or armored transport contractors who typically must follow a specific collection procedure in order to document and assure the continuous chain of custody of deposits from their placement into the depositories through to their receipt by processing personnel responsible for the deposits. In this regard, the collection/transport process requires security personnel to first access the interior vault portion of the bank, ATM or other depository. Normally, since this area is well protected against unauthorized tampering and entry by the public, deposits that enter through the various security deposit door mechanisms of the depositories simply fall into an open container located within the safe. The collection personnel, after accessing the depository vault, empties the container and individually records the retrieved deposits which are then transferred to a security transport bag or the like and thence transported to a designated location for processing.

It is readily apparent that the foregoing retrieval and transport operation depends upon the integrity and honesty of the collecting and transporting personnel, because not only do they have full and completely un-monitored access to the deposits, the actual record of the chain of custody of the retrieved deposits is dependent solely on their own recordation of the deposits they handle. Accordingly, not only does this collection process entail a significant amount of time handling and manifesting deposits collected at each depository, the deposits are open to tampering without any concrete safeguards that can reliably evidence or otherwise discourage tampering with deposits enroute to the bank for processing.

SUMMARY OF THE INVENTION

In its basic concept, this invention provides a deposit retrieval and transport container apparatus which is readily adaptable for use with virtually any type of depository arrangement and operable to receive and collect deposits made through the depository; the transport container being specifically arranged to be removable from the depository arrangement only upon positively-locked installation of a container-sealing security lid member arranged to prevent access to the contents of the transport container until the lid is unlocked and removed by authorized personnel at a destination deposit-processing office, and to evidence and thereby discourage attempts to tamper with deposits by collection and transport personnel.

It is by virtue of the foregoing basic concept that the principal objective of this invention is achieved; namely, to simplify and expedite the heretofore necessary routine collection process required in handling deposits made at bank and remote, unattended depositories by unmonitored collection and transport personnel and to increase the security of such deposits prior to their receipt by a destination banking authority.

Another object of this invention is the provision of a deposit retrieval and transport security apparatus which is adaptable for use in connection with automated teller machine depositories, bank night depositories, checkstand and under counter depositories, gaming table depositories and others as may be desired.

Another object of this invention is the provision of a deposit retrieval and transport security apparatus of the class described which, by maintaining deposits in locked confinement from the time a deposit is made throughout its collection and transport until keyed access is gained by authorized personnel at a bank, will evidence any tampering with deposits having occurred while in the custody of those handling the deposit container.

A further object and advantage of this invention is the provision of a deposit retrieval and transport security apparatus which is of simplified construction for economical manufacture and ease and reliability in use.

The foregoing and other objects and advantages of the present invention will appear from the following detailed description, taken in conjunction with the accompanying drawings of preferred embodiments.

DESCRIPTION OF THE PREFERRED EMBODIMENT

Three illustrative embodiments of this invention are disclosed herein, each of the embodiments sharing the same basic structural components. FIGS. 1–10 illustrate a first embodiment of the invention arranged for use in connection with automated teller machine depositories. FIGS. 11–14 illustrate a second embodiment of the invention arranged for use in connection with bank night depositories. FIG. 15 illustrates a third embodiment arranged for under-counter use or with gaming tables. Each embodiment of the invention, however, includes a mounting frame or chassis member, a removable container, and a multi-function container lid member.

Figure 1:
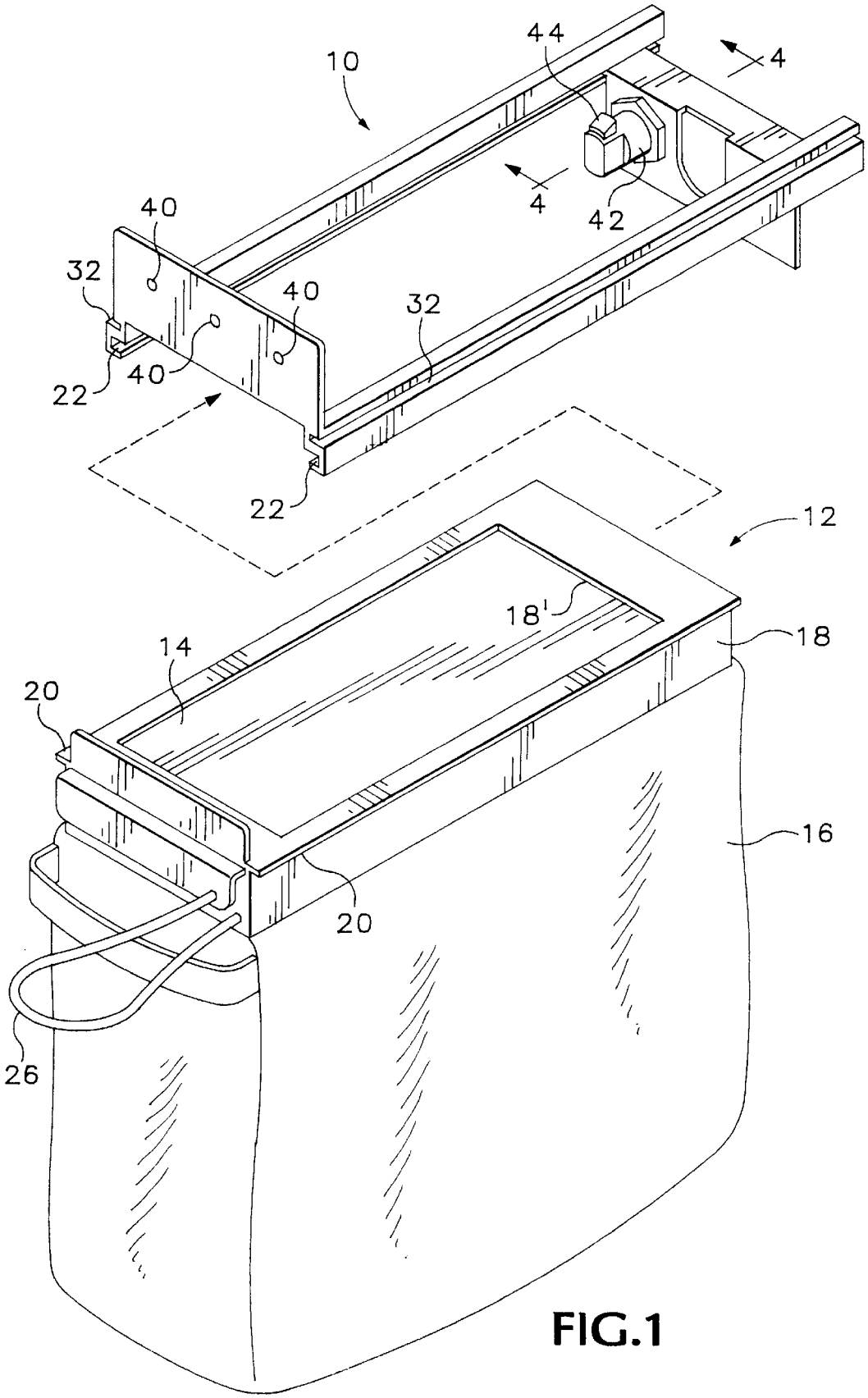
FIG. 1 is a perspective view of a deposit retrieval and transport container apparatus embodying the features of this invention and configured for use in conjunction with a typical automated teller machine depository.

FIG. 1 illustrates the three basic components of the invention configured for use with ATM depositories. As seen, there is a mounting frame member or chassis member 10 arranged for mounting to an ATM machine as will be explained, a deposit collecting and transporting container 12 arranged to be removably supported by the chassis member 10, and a container-covering lid member 14 which provides a unique multiple function that will become clear later. In the particular embodiment illustrated, the deposit container 12 is illustrated in the form of an enlarged flexible bag 16 formed of heavyweight canvas or the like securely mounted in this case to a container top frame 18 about the open top end of the bag. The top frame 18 includes outwardly projecting mounting slide tracks 20 which are configured to correspond with and be received within elongated guide track mounting channels 22 provided on the elongated chassis member 10. As will be understood from the broken arrow line in FIG. 1, the deposit container is slid onto the chassis member and supported thereon by the slide tracks 20 received within the guide track mounting channels 22.

As also seen in FIG. 1, the container top frame 18 includes an enlarged opening therethrough, as defined by opening cutout edges 18', which is releasably closed by the sliding lid panel 14. As will be apparent to those skilled in the art, the top frame 18 is configured with a lid access slot (not shown) through its front face which aligns with longitudinally extending lid-supporting guide tracks 24 (FIG. 7) arranged to permit the lid panel member to be slid into and out of the interior of the top frame beneath the opening therethrough for releasably intercepting the opening and securely preventing access to the interior of the container.

A strap 26 may be provided, if desired, to connect the lid member and the container together to prevent inadvertent loss or misplacing of the lid member when it is not installed in the top frame, as will be discussed later. Accordingly, it will be understood that the deposit container 12 may be slidably installed on and removed from its supporting chassis member 10, and further that the container-sealing lid panel 14 may be slidably installed into and removed from the container top frame 18 and thereby selectively close or open the interior of the container to access.

As is known, automated teller machines handle customer deposits mechanically, ultimately delivering deposits from a deposit infeed door apparatus (not shown) to a depository outfeed apparatus 28 (FIG. 2) where they simply fall by gravity into an underlying, slide in/slide out, open top receptacle (not shown) where the deposits accumulate until emptied by collection personnel. Typically, the deposit receptacle of the ATM machine includes a pair of opposite, longitudinally extending channels adjacent its open top end, these channels configured to engage the pair of laterally-spaced, longitudinally extending, inwardly projecting runners 30 provided on the outfeed apparatus 28 and thereby releasably support the deposit receptacle in a slide on/slide off mount.

Figure 2:
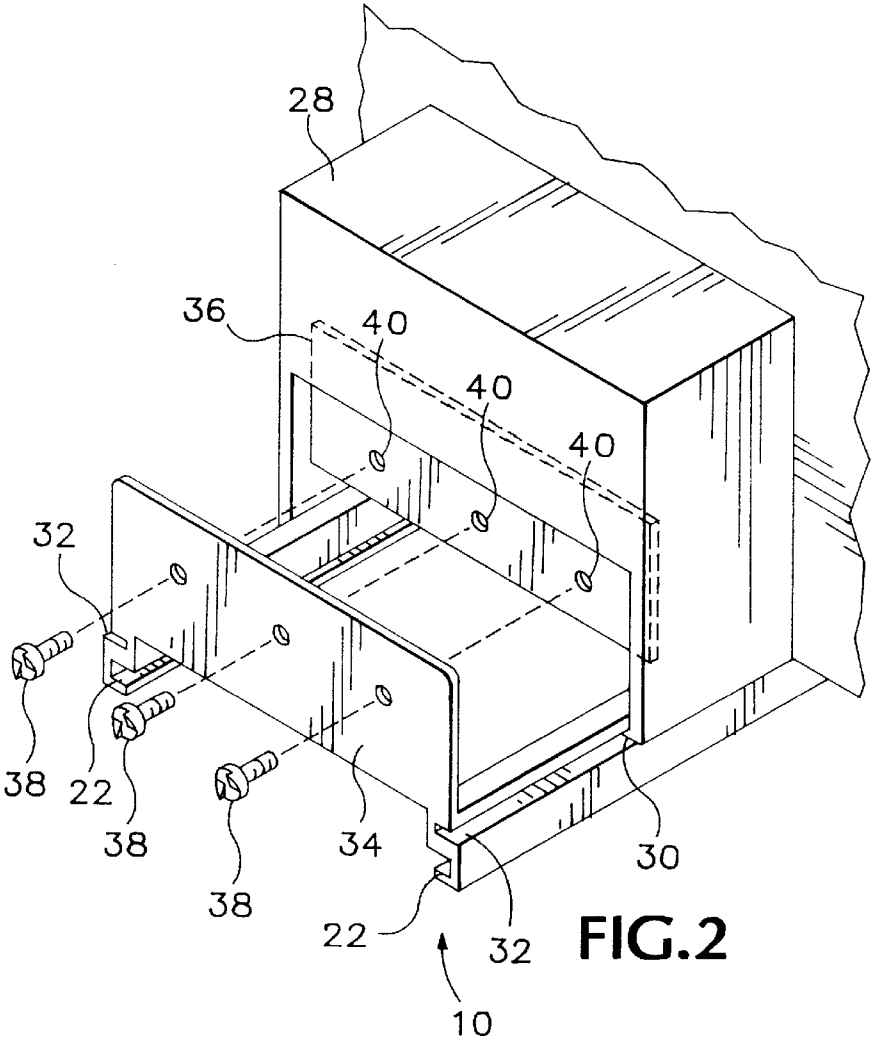
FIG. 2 is a fragmentary perspective view of the depository outfeed of an ATM machine with a chassis member of the retrieval apparatus of this invention shown in the initial stages of installation thereonto.

In the installation of the deposit retrieval and transport apparatus of this invention, the aforementioned original ATM deposit receptacle is simply removed and discarded. The elongated chassis member 10 of this invention, configured with mounting slide channels 32 arranged to engage the runners 30 of the outfeed apparatus 28, is simply slid onto the runners in place of and in the same manner as the original ATM deposit receptacle, as is readily apparent in FIG. 2. This chassis member however, unlike the original deposit receptacle, is secured in installed condition against removal. Means for securing the chassis member in installed condition on the ATM machine is provided, and a simplified but entirely suitable arrangement is illustrated in FIG. 2 wherein the chassis member includes a front end panel 34 which is arranged to engage a clamping plate 36 by non-reversing screws 38 through aligned, threaded bores 40 as will be understood from FIGS. 2 and 3.

Figure 4:
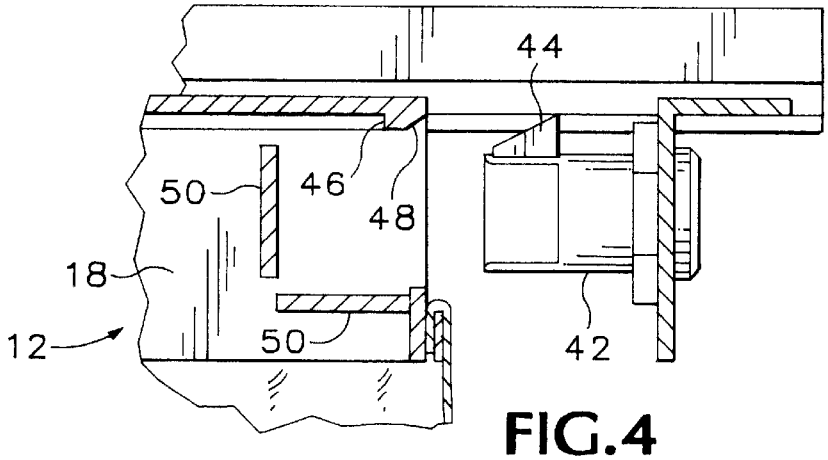
FIG. 4 is a fragmentary sectional view of the container locking mechanism mounted on the chassis member and configured to engage and lockably secure the removable deposit container in place on the chassis member, the view taken along the line 4—4 in FIG. 1.
Figure 5:
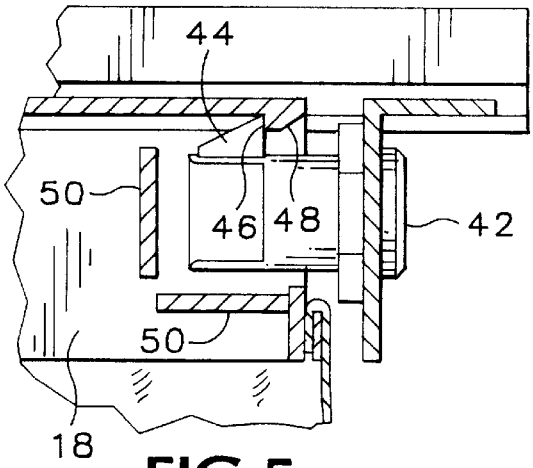
FIG. 5 is a fragmentary sectional view similar to FIG. 4 but showing the deposit container moved into locked condition on the chassis member and secured thereto by a lock member.
Figure 6:
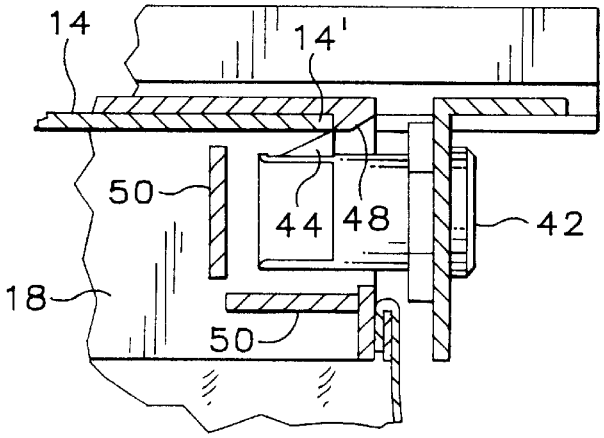
FIG. 6 is a fragmentary sectional view similar to FIGS. 4 and 5 but showing the assembly with the deposit container lid panel member fully installed and overriding the pawl of the lock member to unlock the container from the chassis member for removal and transport.
Figure 7:
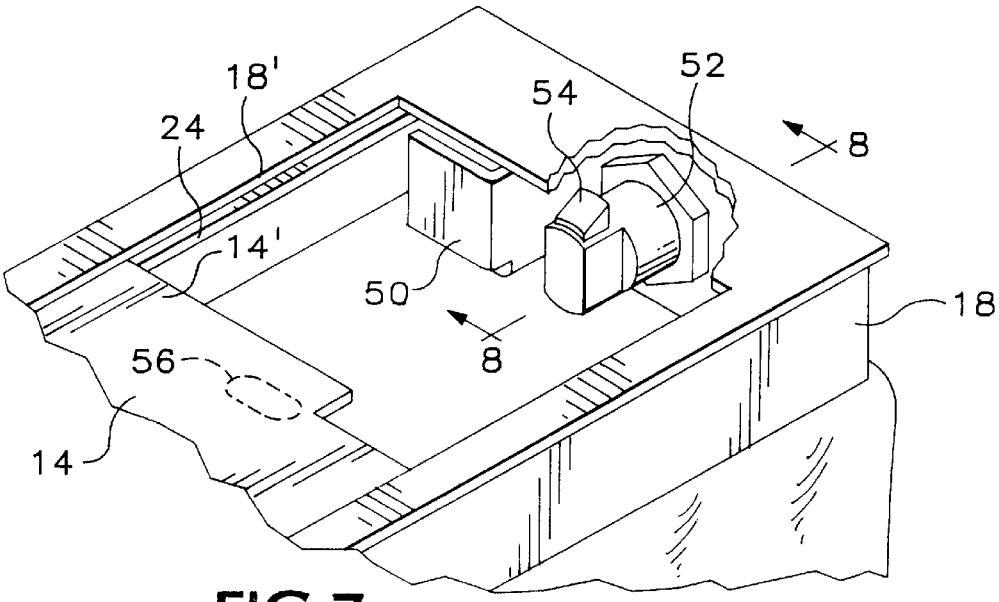
FIG. 7 is a fragmentary perspective view of a portion of the deposit container and a portion of the lid member associated therewith, parts being broken away to show the lock mechanism for the lid member.
Figure 8:
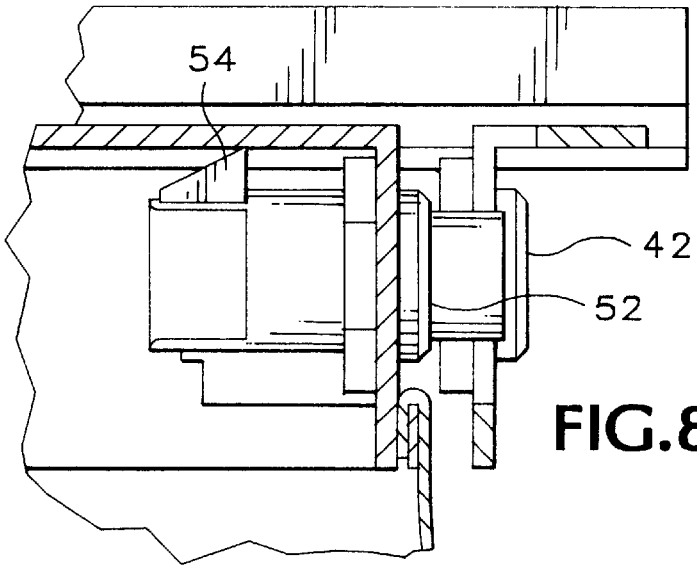
FIG. 8 is a fragmentary sectional view taken along the line 8—8 in FIG. 7.
Figure 9:
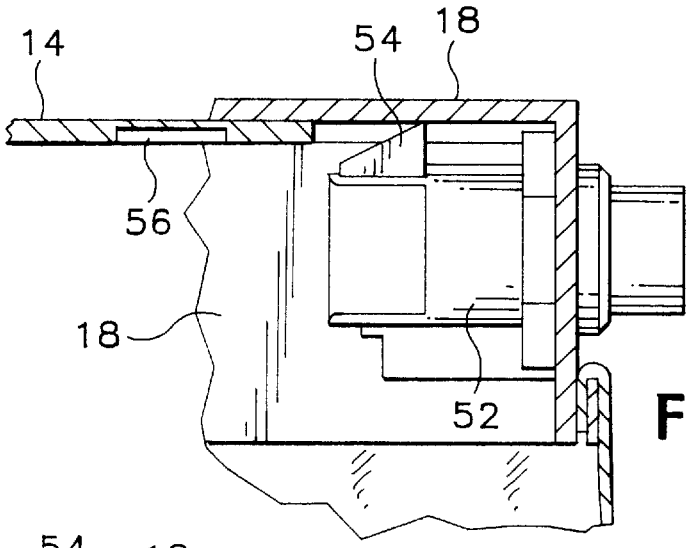
FIG. 9 is a fragmentary sectional view showing the lock mechanism on the deposit container prior to full installation of the container lid member.

Locking means is provided on the chassis member 10 for releasably securing the container 12 in installed condition thereon for receiving deposits delivered through the deposit outfeed apparatus. As seen best in FIGS. 1, 4 and 5 of the drawings, the chassis member embodied herein mounts a lock member 42 having a pawl 44 configured to lockably engage a corresponding catch 46 on the top frame 18 of the container. As will be understood from FIGS. 4 and 5, the pawl 44, biased toward the normally-extended, latching condition shown in FIG. 4, is moved into a retracted condition by the confronting edge 48 of the leading end portion of the container as the container is installed. When the container is installed fully onto the chassis member, the pawl snaps into engagement with the catch 46 and securely locks the container in place against removal, as seen in FIG. 5. A protective security shield 50 is provided to prevent access to the interior of the container when it is removed from the chassis member.

A second locking means is provided on the container 12 for releasably securing the lid panel member operatively in position securely closing the container. In this regard, attention is directed primarily to FIGS. 7, 9 and 10 of the drawings wherein the container top frame 18 mounts a lock member 52. In this example the lock member is generally similar to the aforementioned lock member 42, but further provided for key-operated retraction of its pawl 54 whereby to unlock the lid member, as will become clear.

Figure 10:
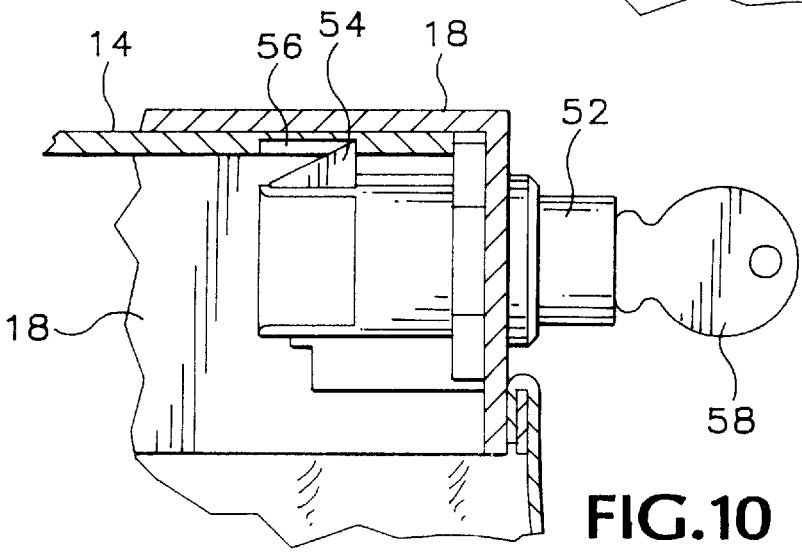
FIG. 10 is a fragmentary sectional view similar to FIG. 9 but showing the container lid member fully installed and in locked engagement with the lock member.
Figure 11:
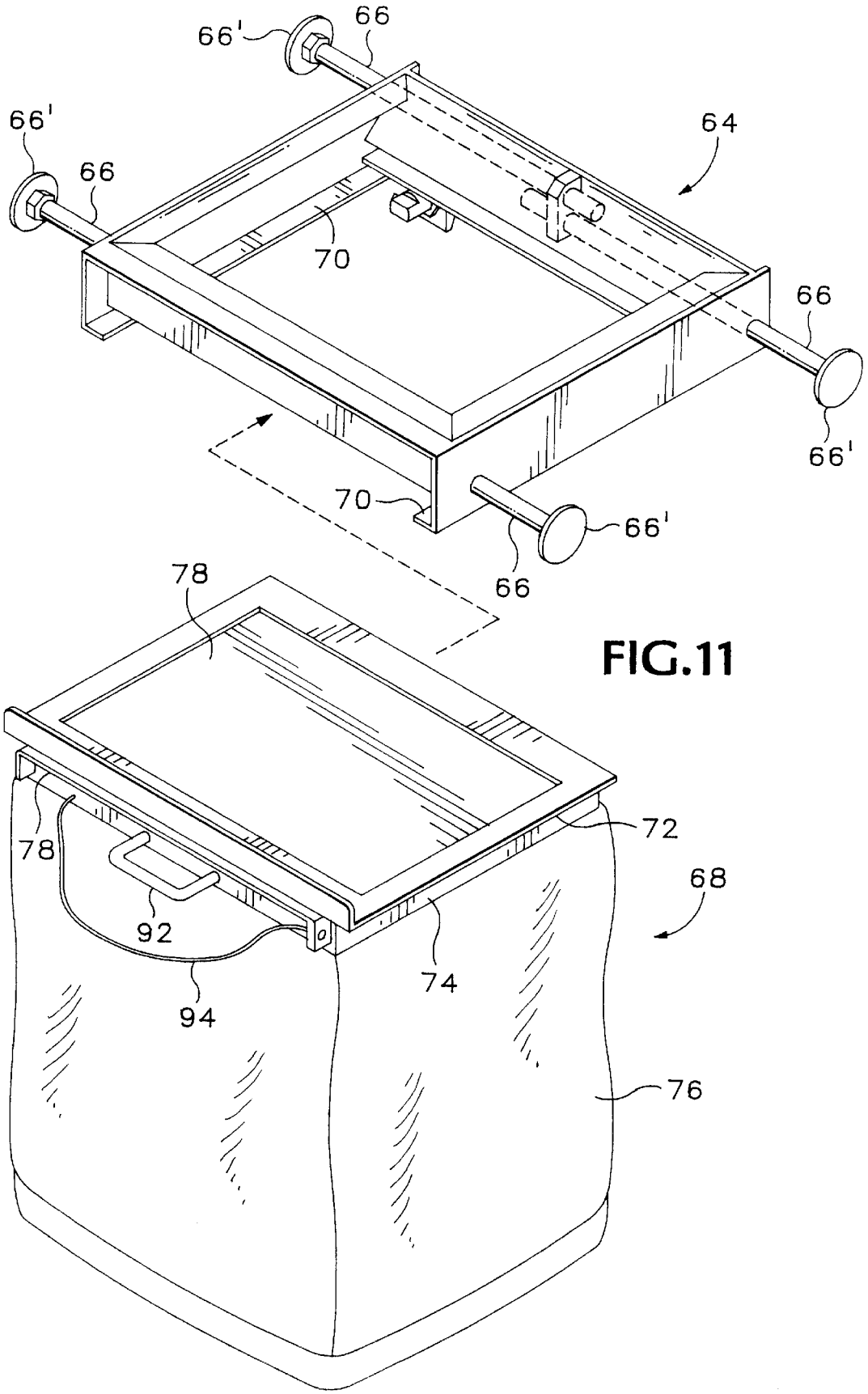
FIG. 11 is a perspective view similar to the view of FIG. 1 but showing a second embodiment of the invention configured for use with bank night depositories.
Figure 12:
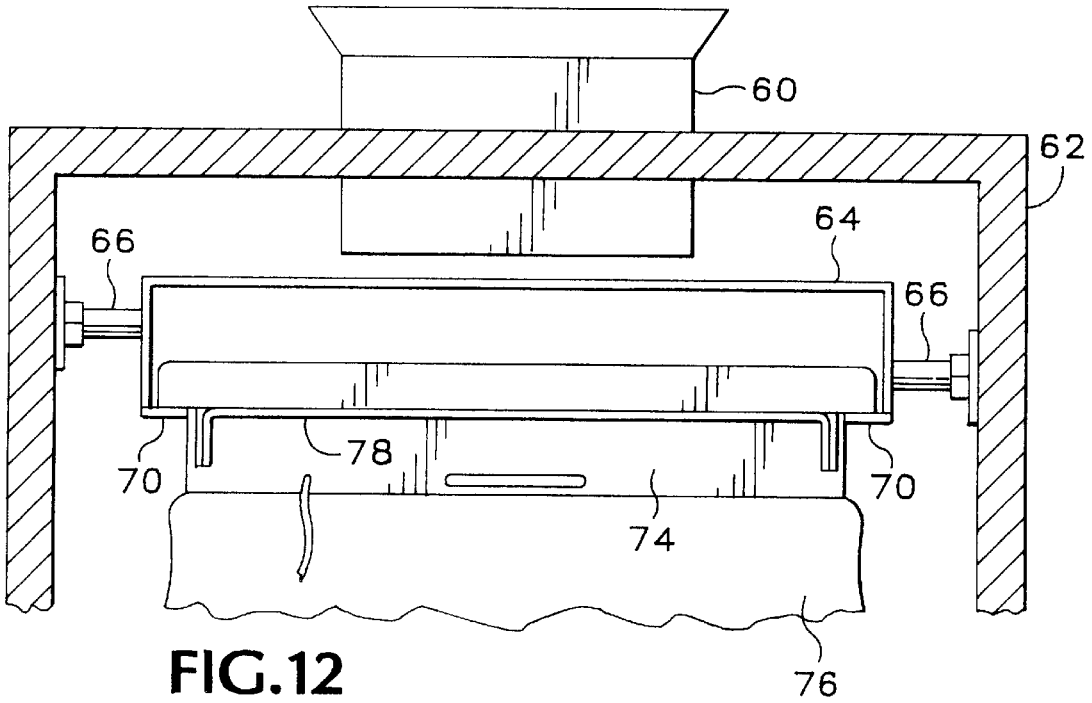
FIG. 12 is a fragmentary side elevation of a depository safe with the invention installed in place beneath the deposit chute which communicates with the security deposit door arrangement (not shown) of the depository.
Figure 13:
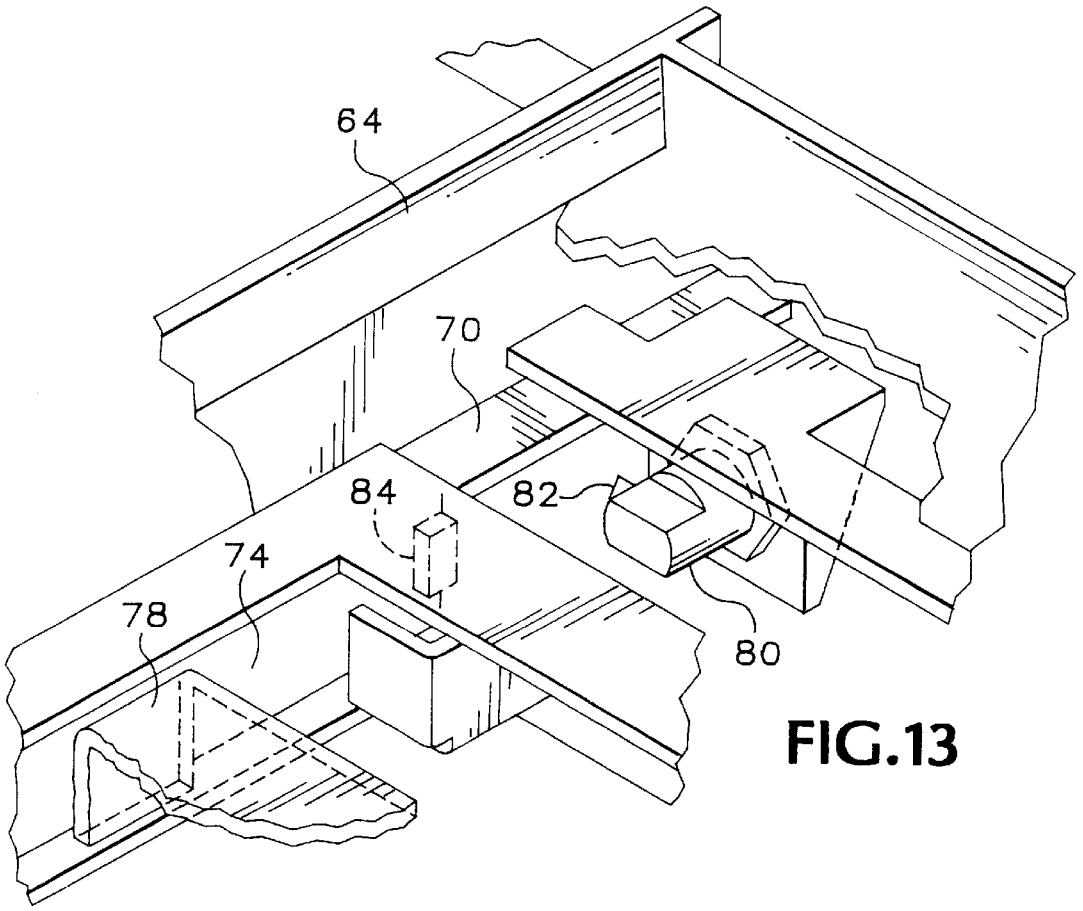
FIG. 13 is a fragmentary perspective view showing an alternative lock arrangement on the chassis member arranged to secure the deposit container thereto.

As shown, the lid member 14 is configured with a catch 56 on its inside surface arranged and positioned for locking engagement by the pawl 54 of the lock member 52 when the lid is in fully installed condition on the container, as seen in FIG. 10 of the drawings. Once the lid panel member is locked in place a key 58, typically maintained in the custody of the deposit-receiving bank, is used to operate the lock member to retract the pawl 54 from engagement with the catch 56, whereupon the lid may be removed and the contents of the container accessed for processing.

The deposit retrieval and transport apparatus of this invention includes means for unlocking the container from the chassis member and permitting its removal therefrom only after the lid panel member has been installed in fully locked condition on the container. In the particular embodiment illustrated, the lid member 14 includes a projecting tab portion 14' that is configured so that, after the lid member is in the fully installed, locked condition of FIG. 10 of the drawings, the lid may be moved slightly further, moving the leading edge of the tab member 14' into the position illustrated in FIG. 6 of the drawings in which it has engaged the confronting, tapered surface of the pawl 44 and moved the pawl into retracted condition disengaging it from the locking catch 46, and thereby effectively unlocked the container from the chassis member and permitting its removal therefrom.

Accordingly, it will be understood that in the final stages of sliding the lid panel member into place, the lid member 52 first operatively engages its corresponding catch member 56 on the lid, and only after the lid has been installed at least that far is the projecting tab portion 14' in position to operatively engage the container-locking pawl to unlock the container, as has been described. In this manner it is readily apparent that the lid member not only serves to securely cover the opening of the container and protect the contents inside, it effectively provides the key which unlocks the container and permits it to be removed from the chassis member.

Figure 3:
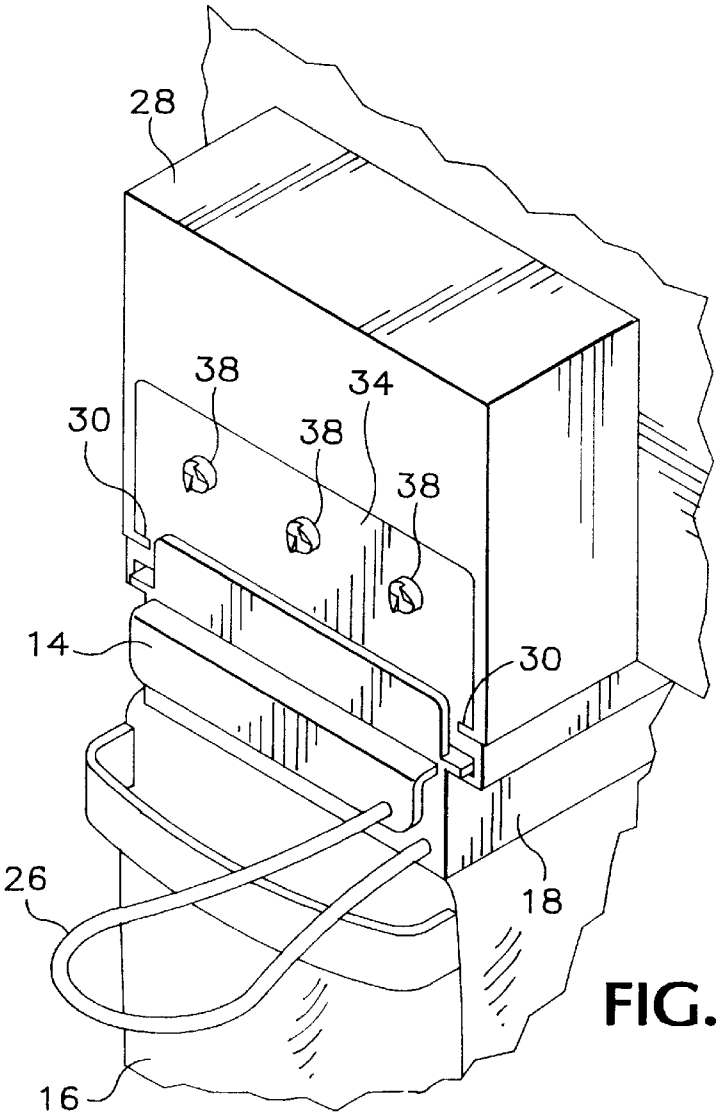
FIG. 3 is a fragmentary perspective view of the ATM outfeed operatively mounting the deposit retrieval and transport apparatus of this invention with the container cover lid shown in locked, covering condition on the container member prior to its removal and transport to a banking facility.

Once installed in an ATM machine, the operation of the apparatus just described is as follows:

Collection personnel gain access to the interior of the ATM machine in the usual manner and then simply insert the lid panel 14 into its slot (not shown) in the top frame of the container, pushing the panel all the way in. Just prior to full insertion of the lid panel, the pawl 44 of the lid panel-locking member 42 operatively engages the lid panel and prevents its removal. The container, now closed by the locked lid member, is at this point still locked in place on the chassis member beneath the depository outfeed apparatus of the ATM machine as seen in FIG. 3. The collection personnel may then press the lid panel inward slightly more whereby the confronting edge of the projecting tab portion 14' of the lid panel member is moved operatively into overriding engagement with the pawl 44, moving the pawl out of engagement with the catch 46 on the chassis member and thereby unlocking the container from the chassis member. The collection personnel then simply pulls the container member out of the ATM machine, and transports it to an assigned location for processing of the deposits where authorized personnel are in possession of the appropriate key 58 to unlock and remove the lid from the container. When the filled container is removed from the ATM machine, it is replaced with an empty container which had been processed at an earlier time and has had its lid member unlocked and removed. The empty, open container member is simply slid onto the chassis member as has been described until it locks into place by engagement of the pawl 44 of the lock member 42 on the chassis member with the catch 46 on the container.

It will be apparent from the foregoing that the collection operation is rendered extremely time-efficient and secure, and completely eliminates and prevents access to the deposits from the time the deposits are made until they are ultimately received by authorized accounting and processing personnel in a bank. Any tampering or theft of deposits will be immediately evident to the bank personnel by virtue of the necessary damage that must occur to the container or the lid member in such an attempt.

The invention as embodied in FIGS. 11–14 is configured for installation and use in conjunction with typical bank night depositories in which a depository outfeed chute 60 communicates deposits from an outside deposit security door apparatus (not shown) to the interior of a safe 62. Normally container (not shown) not unlike a waste container is simply placed in the safe vault beneath the chute 60 to receive deposits falling thereinto. In this embodiment, a chassis member 64 is configured for universal mount within a safe beneath the chute 60. As is readily apparent in FIGS. 11 and 12, this chassis member is provided with threaded mounting legs 66 which may be extended or retracted as needed to position the chassis member directly beneath the outfeed chute. As will be obvious to those skilled in the art, the leg members are simply threaded outwards until their foot members 66' securely engage the inside walls of the safe. Preferably, a high strength epoxy is applied to the foot members before installation of the chassis member to prevent and evidence unauthorized tampering. Like the earlier-described chassis member 10, the chassis member 64 includes a housing configured to receive and support a corresponding container 68 in a simple slide-on mount. Support rails 70 are provided to slidably receive corresponding mounting slide flanges 72 projecting from and extending along the interior side walls of the container top frame 74, which also securely mounts a depending deposit bag 76.

Similar to the earlier-described embodiment, the container 68 of this embodiment includes a slide on/slide off lid panel member 78 configured to provide the same multiple function as the lid panel member 14 described earlier. It is to be understood that, if desired, the lid member and arrangement of lock members may be configured as as been described in connection with the first embodiment of the invention. However, an alternative arrangement is illustrated in this embodiment to show that other lock arrangements are equally suitable for the purpose.

In this form of the deposit retrieval and transport security apparatus of this invention a container-securing lock member 80 is mounted on the chassis member 64 and includes a biased pawl 82 arranged to engage a catch 84 provided on the top frame 74 of the container 68 when the container is fully installed on the chassis member. So engaged by the lock member, the container 68 is secured in locked condition underlying the chute of the night depository.

Figure 14:
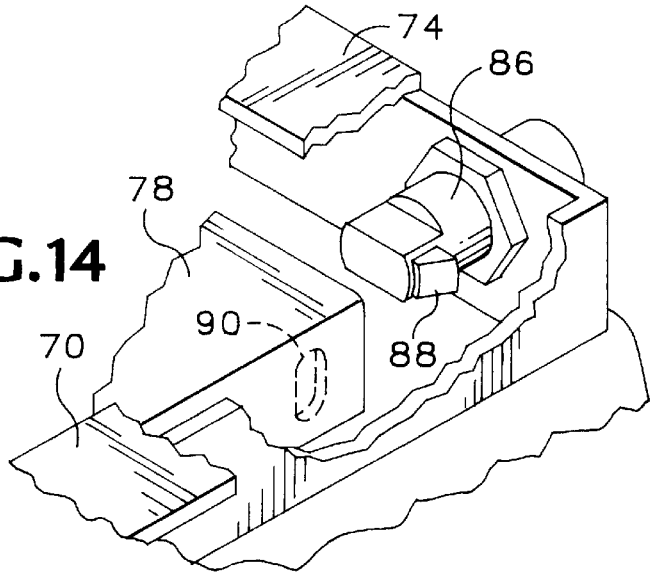
FIG. 14 is a fragmentary perspective view showing an alternative lock arrangement on the deposit container arranged to lockably secure the container cover lid member thereto.
Figure 15:
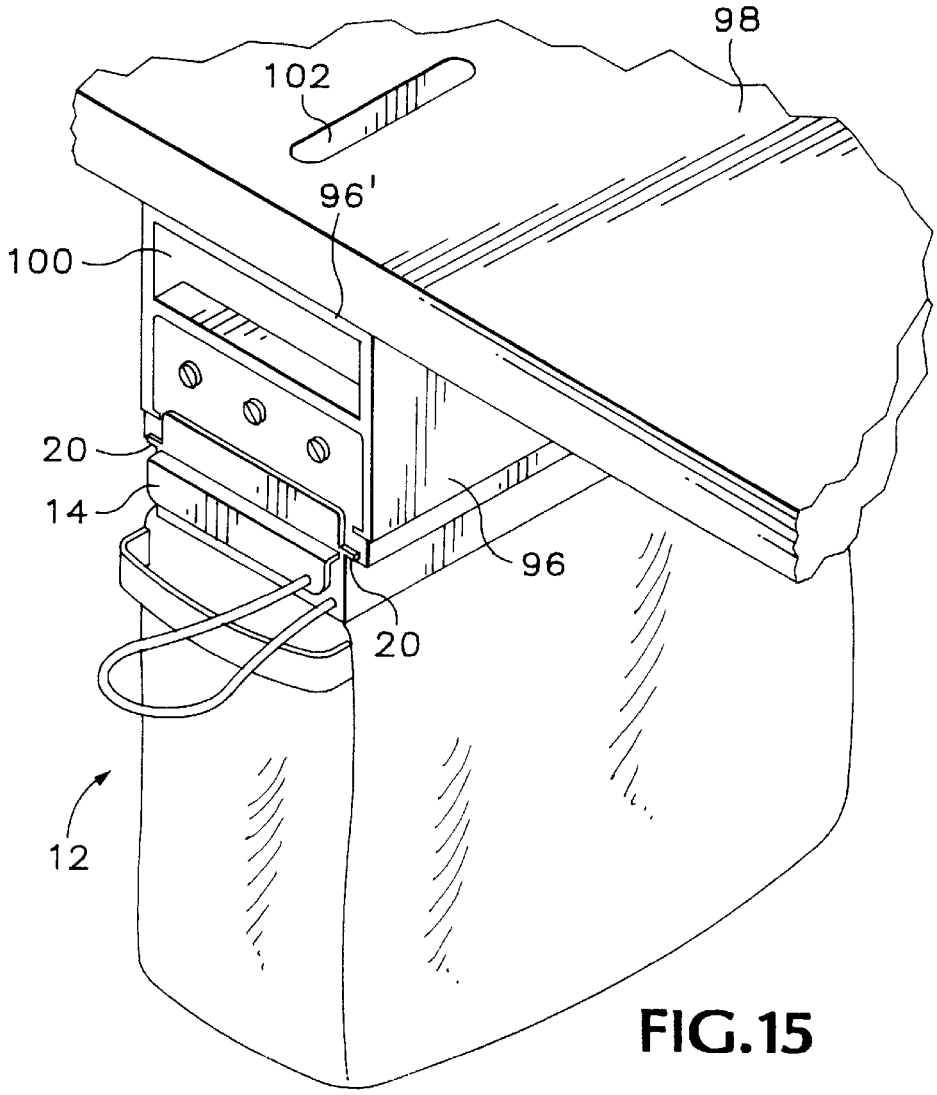
FIG. 15 is a fragmentary perspective view of a third embodiment of the invention arranged to provide under-counter and gaming table depositories.

As seen in FIG. 14 of the drawings, the top frame 74 of the container 68 mounts a lid-securing lock member 86 having a biased pawl 88 configured to operatively engage a catch 90 on the lid member when the lid member is installed substantially fully onto the container. The lock member 86 is provided for key operation to retract the pawl and unlock the lid, the key for which is preferably maintained only by designated, authorized bank personnel at a receiving deposit-processing facility.

As will be understood from the detailed description of the first embodiment of the invention, the positioning and configuration of the aforementioned lock members requires that upon installation of the lid member 78 as it is slid into container-enclosing condition, the lid-locking lock means will operatively engage to secure the lid in locked, covering condition prior to full, overriding engagement of the lid member with the pawl 82 of the container-securing lock member 80.

The operation of the apparatus of this embodiment is substantially identical to that as described in connection with the first embodiment of the invention. The removable container 68 may be provided with one or more carrying handles 92 to facilitate the handling of the container. Also, a lid strap member 94 may be provided to tie the lid member to the container to prevent inadvertent loss or misplacing of the lid member when it is not in use.

FIG. 15 shows a third embodiment of the invention to illustrate that the apparatus is readily adaptable for use in applications other than banking depositories. In this embodiment, the apparatus is substantially identical to the apparatus described in connection with FIGS. 1–10 of the drawings, with the single exception being that instead of configuring the chassis member 10 (FIG. 1) for operative connection to the existing structure of an ATM depository, the modified chassis member 96 of this embodiment is configured as needed for mounting in the particular environment in which it will be used.

In this regard, the chassis member is configured with a depository enclosure structure 96 arranged to be mounted, as by screws (not shown), to the underside of a table or counter 98. For purposes of illustration herein, the depository enclosure includes a deposit slot 100 arranged to permit deposits to be passed into the confines of the chassis enclosure whereupon they will fall into the container of the apparatus. Alternatively, or if desired, in combination with the aforementioned deposit slot 100, the top wall 96' of the chassis enclosure 96 may be provided with a suitable opening therethrough (not shown) for alignment with a deposit slot 102 provided through the supporting counter or table for passage of deposits therethrough and into the container such as is commonly done in connection with gaming tables and the like. The arrangement and operation of the container 12, lid panel member 14 and corresponding lock arrangements (not shown) may be identical to those described in connection with the embodiment of FIGS. 1–10 of the drawings.

From the foregoing it will be apparent to those skilled in the art that the present invention provides a novel deposit retrieval and transport security apparatus that is extremely versatile and efficient in providing for the security of deposits throughout the chain of custody from the time a deposit is made until it is ultimately received by authorized personnel at a remote, designated location. It will also be apparent to those skilled in the art that various changes other than those already described may be made in the size, shape, type, number and arrangement of parts described hereinbefore without departing from the spirit of this invention or the scope of the appended claims. For example, other types of locking arrangements may if desired be substituted for those described and illustrated herein, provided that the fundamental requirement is met that the lid member be fully locked in covering position before it triggers the unlocking of the container from the chassis member. Suitable alternative lock arrangements may include known electronic or magnetic locks which may be activated by corresponding components provided on or incorporated into the lid member as will be well-understood to those skilled in such lock arrangements.

Also, although a flexible, canvas bag has been illustrated herein as providing a suitable container for purposes of evidencing any tampering with the deposits contained therein, the container may instead be formed of more secure, rigid material such as metal or the like if a higher degree of security of the contents of the container is desired. Also, although a key-operated lock is shown in connection with the lid-securing lock means, locks utilizing operator means other than the simple key illustrated herein are obviously contemplated herein.

Having thus described our invention and the manner in which it may be used, we claim:

1. In an automatic teller machine having depository apparatus securely attached to the machine and including a fixed receptacle support for removably supporting a receptacle for collecting deposits from the depository apparatus, a deposit containment and transporting apparatus for replacing the removable receptacle of the machine for securing deposits against access during their retrieval and transport to an authorized deposit-receiving and processing center, the deposit containment and transporting apparatus comprising:

a) a chassis member configured for mounting on and secure, locked attachment to the receptacle support of the depository apparatus of an automatic teller machine in replacement of the removable receptacle of the machine, the chassis member having an opening therethrough for the free passage of deposits from the depository apparatus, b) a deposit collecting and transporting container member, c) interengaging connector components on the chassis member and container member for releasably securing the container member to the chassis member for receiving deposits from the depository apparatus, d) container locking means releasably interengaging the chassis member and container member for releasably locking the container member to the chassis member in the deposit-receiving position of the container member, e) a container lid member for removably closing the open end of the container member, f) interengaging connector components on the container lid member and container member configured to allow movement of the container lid member between container-opening and container-closing positions, g) interengaging lid locking means on the lid member and container member for automatically locking the lid member in said container closing position for securing the contents of the container member against removal, h) container lock release means on the container lid member operable by movement of the lid member to a second position still closing the container member but engaging and releasing said container locking means to allow removal of the container member from the chassis member with the lid member securely locked in closed position, and i) lid unlocking means operable at the authorized deposit-receiving and processing center for unlocking the lid member from said container member to allow opening of the container member and retrieval of the deposits contained therein.

2. In an automatic teller machine having depository apparatus securely attached to the machine and including a fixed receptacle support for removably supporting a receptacle for collecting deposits from the depository apparatus, a deposit containment and transporting apparatus for replacing the removable receptacle of the machine for securing deposits against access during their retrieval and transport to an authorized deposit-receiving and processing center, the deposit containment and transporting apparatus comprising:

a) a chassis member having front and rear ends and configured for mounting on and secure, locked attachment to the receptacle support of the depository apparatus of an automatic teller machine in replacement of the removable receptacle of the machine, the chassis member having an opening therethrough for the free passage of deposits from the depository apparatus, b) a deposit collecting and transporting container member having an open upper end through which to receive deposits from the depository apparatus, the open upper end defining front and rear ends of the container member, c) interengaging slide components on the chassis member and container member configured to support the container member on the chassis member for movement between a rearward position at the rearward end of the chassis member and a forward position detached from the forward end of the chassis member, d) container locking means releasably interengaging the chassis member and the container member for releasably locking the container member in operative position on the chassis member for receiving and collecting deposits from the depository apparatus, e) a container lid member for removably closing the open end of the container member, f) interengaging slide components on the container lid member and container member for supporting the lid member for movement from the front end of the container member to the rear end thereof for closing the open top of the container member and for movement from the rear end of the container member to the front end thereof for opening the open top of the container member for receiving deposits from the depository apparatus, g) interengaging lid locking means on the lid member and container member for automatically locking the lid member in said container closing position for securing the contents of the container member against removal, h) container lock release means on the container lid member operable by movement of the lid member further rearward from said automatic lid-locking position to engage and release said container locking means to allow removal of the container member from the chassis member with the lid member securely locked in closed position, i) lid unlocking means operable at the authorized deposit-receiving and processing center for unlocking the lid member from said container member to allow opening of the container member and retrieval of the deposits contained therein.

3. The automatic teller machine and deposit containment and transporting apparatus of claim 2 wherein said container locking means comprises a latch member mounted on the chassis member and having a biased pawl configured to engage a corresponding catch provided on the container member when the latter is operatively installed on the chassis, and said lid member locking means comprises a first component of a lock member mounted on the container member and configured to lockably engage a corresponding second lock component on the lid member after the lid member has been moved into said container closing position on the container member, and the container lock release means includes a projecting, latch-overriding portion on the lid member configured to engage the latch member on the chassis member to disengage the pawl from its corresponding catch on the container when the lid member is moved into its contents securing position on the container and the first and second lock components associated with the lid member have lockably engaged to prevent removal of the lid member from the container.

* * * * *